United States Patent [19]

Hodges

[11] Patent Number: 5,018,224

[45] Date of Patent: May 28, 1991

[54] STACKABLE SOIL PIPE SPACER FLANGE

[76] Inventor: B. Eugene Hodges, 761 Palmer Dr., Greenville, Mich. 48838

[21] Appl. No.: 451,638

[22] Filed: Dec. 18, 1989

[51] Int. Cl.[5] ..... E03D 11/00

[52] U.S. Cl. ..... 4/252 R; 4/DIG. 7; 4/DIG. 9; 4/661; 285/56; 285/59; 285/60

[58] Field of Search ..... 4/252 R, DIG. 7, DIG. 9, 4/237, 328, 345, 661; 285/56–60

[56] References Cited

U.S. PATENT DOCUMENTS

| | | | |
|---|---|---|---|
| 571,471 | 11/1896 | Davis | 4/252 R |
| 2,673,985 | 4/1954 | Gay | 285/56 X |
| 4,384,910 | 5/1983 | Prodyma | 4/DIG. 7 |
| 4,515,398 | 5/1985 | Machon, Sr. | 285/59 |
| 4,631,759 | 12/1986 | Strasser | 285/56 X |
| 4,794,653 | 1/1989 | Strasser | 285/56 X |

*Primary Examiner*—Henry K. Artis

*Attorney, Agent, or Firm*—Bullwinkel Partners, Ltd.

[57] ABSTRACT

A stackable self-aligning and self-sealing plastic spacer for extending a soil pipe flange to floor level to meet a toilet fixture has a ring-shaped spacer with a tapered inner collar protruding from its surface. The collar is received within the similarly tapered central opening of the next adjoining spacer. The spacers are made of resilient plastic to provide a wedging fit that seals the joint against leakage.

5 Claims, 1 Drawing Sheet

STACKABLE SOIL PIPE SPACER FLANGE

BACKGROUND OF THE INVENTION

This invention relates to the plumbing trades, and in particular to an improved spacer for extending the opening of a soil pipe flange to floor level while maintaining a positive seal against leakage.

In residential and commercial construction, the soil pipe is the conduit for directing wastes from a sink or toilet into the sewer below. The soil pipe conventionally terminates in a ring-shaped flange having spaced openings for receiving bolts or the like which are used to secure the flange to the toilet fixture above.

When a soil pipe is first installed, the floor above has usually been roughed in by the carpentry or concrete trades, but has not been finished. After the finished floor has been installed on top of the rough floor, the final level of the toilet fixture is typically somewhat higher than the soil pipe flange, requiring some kind of spacer or extension to bring the flange into sealing relationship.

A similar problem is encountered in older buildings, where a soil pipe (also called a soil stack) may have settled relative to the original floor, or where a new floor has been installed on top of the old one, requiring additional spacing to securely connect the fixture to the soil pipe flange.

In the prior art, wax rings and other deformable spacers have long been used in the trade, sometimes with inadequate results. Wax is capable of conforming to the mating surfaces of the parts to be joined, but is awkward to use and has only limited resilience and very little strength.

Also in the prior art, simple extension flanges have been employed, as exemplified by the Prodyma U.S. Pat. No. 4,384,910 (May 24, 1983) but such devices must also utilize conventional wax rings and flexible adhesives (mastic) for maximum effectiveness. They must also be provided in numerous sizes to accommodate the many different soil pipe spacing problems which may be encountered by the plumber.

It is therefore a principal object of the invention to provide an improved spacer for connecting a soil pipe with a fixture in which a positive seal is achieved without the use of wax rings or mastic adhesives.

It is a further object of the invention to provide an improved spacer which may be supplied in predetermined thicknesses to allow stacking in various combinations to accurately match widely varying requirements of soil pipe extension with just a few basic spacer elements.

SUMMARY OF THE INVENTION

The stackable spacer element of the invention is ring-shaped to cooperate with a correspondingly shaped soil pipe flange, and has a central opening corresponding to the opening of the water closet, toilet or other fixture which needs to be fitted to a soil pipe and flange. When a new floor has been installed, the floor level will often be found to have been substantially raised from its original position.

In such a situation, a spacer must be fitted between the fixture and flange to maintain a proper seal. Rather than make the plumber carry a variety of spacers of different thicknesses, the spacer elements of the present invention can simply be stacked to build up to the proper thickness to provide the necessary spacing between the toilet flange and the fixture.

To achieve a satisfactory seal between adjoining stacked spacer elements, the ring-shaped spacer is provided with a tapered inner collar protruding from its surface. The collar is received within the similarly tapered central opening of the next adjoining spacer. The spacers are made of resilient plastic to provide a wedging fit that seals the joint against leakage.

THE DRAWINGS

DETAILED DESCRIPTION OF THE INVENTION

Figure 1:
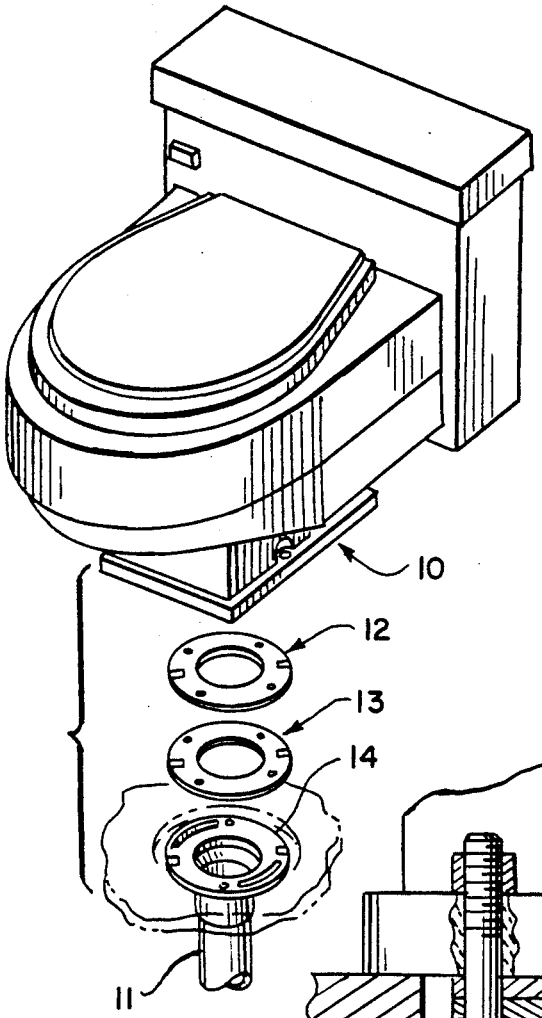
FIG. 1 is an exploded perspective of the stackable toilet flange spacer elements of the present invention, showing its assembled relationship to a typical water closet, soil pipe flange and soil pipe.

Turning to the drawings, there is shown in FIG. 1 an exploded view of an assembly of elements for extending a soil pipe opening upward to mate with the corresponding surface of a toilet fixture 10. The soil pipe 11 is spaced from the fixture 10 by two spacer elements 12, 13 constructed according to the invention. The fixture 10 is secured by bolts to a flange 14 attached to the soil pipe 11.

The spacer elements 12, 13 may be of the same thickness or of different thicknesses. Preferably, the spacer elements are provided in several thicknesses such as $\frac{1}{4}$ inch, $\frac{3}{8}$ inch and $\frac{1}{2}$ inch. By providing such a choice of thicknesses, the plumber may choose the combination of thicknesses that will create a stack having close to the exact height needed for each job.

Figure 2:
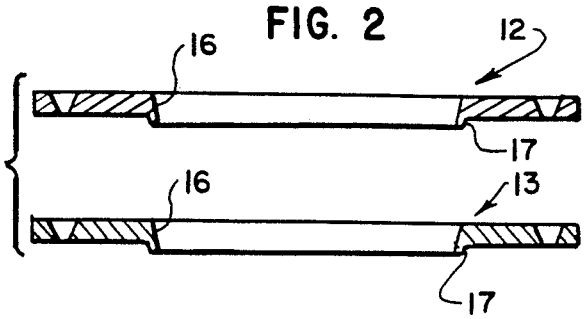
FIG. 2 is a side cross-sectional elevation of the toilet flange spacer elements of the invention, showing two such elements in co-axial relationship prior to final assembly.
Figure 3:
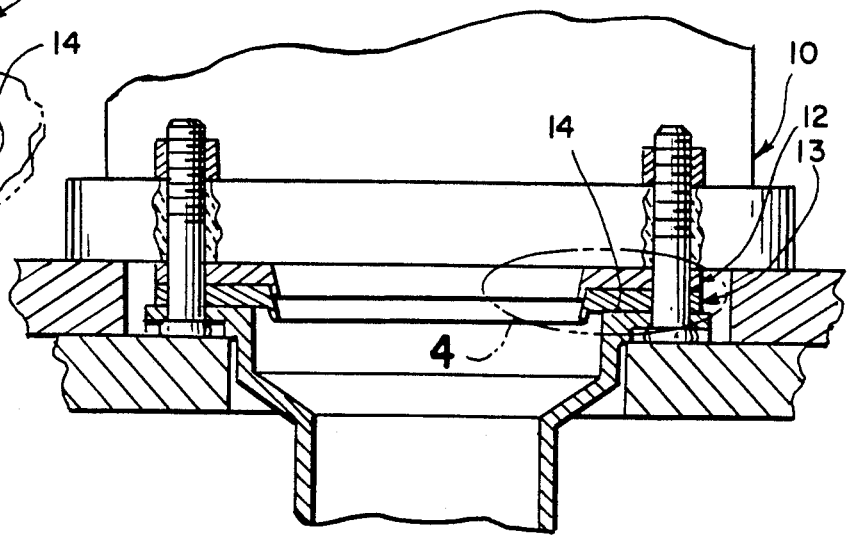
FIG. 3 is a side view of the spacer elements of FIG. 2, shown in assembled relationship with the soil pipe flange and fixture, showing the seal area in the circle 4.

According to the invention, the elements 12, 13 are made self-aligning and self-sealing through the provision of a tapered conical central opening 16 (FIG. 2) ending in a circumferential collar or rim 17. The collar 17 of each element is received within the opening 16 of the next element, making the stack self-aligning.

As a further feature of the invention, the dimensions of the conical opening 16 and upstanding collar 17 are such that two adjacent elements will fit together with a slight interference fit. Because the elements are preferably made of molded resilient plastic, the mating parts experience a slight degree of elastic deformation which makes them conform to each others' surfaces to positively seal the joint between them without the need for wax, mastic or other sealants or adhesives.

Preferably, the elements 11, 12 are injection molded from resilient plastic selected from the following group:

Nylon
Polyethylene
Polypropylene

Figure 4:
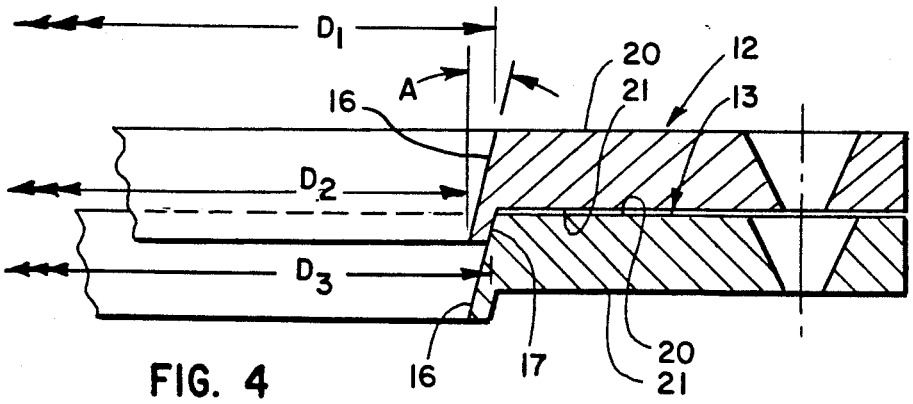
FIG. 4 is an enlarged partial sectional view of the circled area 4 of the assembled elements of FIG. 2.

Referring particularly to FIG. 4, each element of the invention 12, 13 consists of a body having has an upper surface 20 and a lower surface 21, the surfaces defining parallel planes. Extending between the surfaces is the tapered conical opening 16, having a first diameter $D_1$ and a second diameter $D_2$ which is smaller, thereby defining the degree of taper.

In practice, it has been found that the angle of taper A is preferably chosen between five degrees (5°) and forty degrees (40°). Too sharp a taper (too great an angle from the axis of the opening) makes the parts easy to assemble but reduces the wedging forces available to drive the two adjacent elements into sealing relationship with each other. Too shallow a taper (too small an angle from the axis of the opening) increases the sealing forces between the elements but increases the requirement of precision in manufacture.

The preferred embodiment of the invention utilizes an interference fit between mating elements 12, 13. This is achieved by making the outer diameter of the collar $D_1$ slightly than the inner diameter of the opening on the upper surface 20 into which it fits. The outer diameter is defined by the intersection of the collar with the second surface. Preferably, the collar outer diameter is about fifty thousandths (0.050) inches larger than the inner diameter of the opening of its mating element.

Typically, the preferred embodiment is supplied to the plumber as a set of elements of different thicknesses. The plumber measures the distance to be filled between the soil pipe and the fixture, and then selects the combination of two or more elements which comes closest to exactly filling the distance. For instance, a ¼ inch element supplied with a ½ inch element will fill gaps of ¼ inch to ¾ inch, and if two kits are purchased, the range is doubled, all in ¼ inch increments.

I claim as my invention:

1. A stackable self-aligning and self-sealing spacer for extending a soil pipe flange to floor level to meet a toilet fixture, said spacer being characterized by:

a ring-shaped body sized to cover a soil pipe flange and having spaced fastener openings circumferentially disposed for receiving threaded fastening means to interconnect said soil pipe flange, spacer and toilet fixture, said body being defined by parallel surfaces intersected by a conical opening corresponding to the inner diameter of the smallest soil pipe flange to be accommodated, said opening having a wide end and a narrow end, said body including an axially protruding elastically deformable annular collar defining an axial extension of the narrow end of said conical opening, and said collar having an outer conical surface adapted to be received in wedging self-centering sealing relationship with the conical opening of a second spacer of like construction when the spacers are assembled in stacked relationship about a common axis.

2. The spacer of claim 1 in which the body is molded of resilient plastic material selected from the group comprising polypropylene, polyethylene and nylon.

3. In combination, first and second stackable spacers constructed according to claim 1, said spacers being assembled in stacked relationship about a common axis.

4. The combination of claim 3 in which the first and second spacers are of different thicknesses.

5. The spacer of claim 1 in which said conical opening defines a cone angle of greater than 5° and less than 40°.

* * * * *

UNITED STATES PATENT AND TRADEMARK OFFICE

CERTIFICATE OF CORRECTION

PATENT NO. : 5,018,224

DATED : May 28, 1991

INVENTOR(S) : B. Eugene Hodges

It is certified that error appears in the above-identified patent and that said Letters Patent is hereby corrected as shown below:

Column 3, line 17, after "slightly" insert -- larger --.

Signed and Sealed this

First Day of December, 1992

*Attest:*

DOUGLAS B. COMER

*Attesting Officer*

*Acting Commissioner of Patents and Trademarks*